US005912611A

United States Patent [19]

Berggren et al.

[11] Patent Number: 5,912,611

[45] **Date of Patent: *Jun. 15, 1999**

[54] SURGE ARRESTER

[75] Inventors: Soren Berggren, Vasteras; Jonas Engstrom, Ludvika; Gunnar Hellstrom, Ludvika; Bjorn Lindberg, Ludvika; Jan Lundquist, Ludvika; Bertil Moritz, Vasteras; Hakan Wieck, Ludvika, all of Sweden

[73] Assignee: Asea Brown Boveri AB, Vasteras, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/793,516

[22] PCT Filed: Aug. 25, 1995

[86] PCT No.: PCT/SE95/00963

§ 371 Date: Jun. 2, 1997

§ 102(e) Date: Jun. 2, 1997

[87] PCT Pub. No.: WO96/07186

PCT Pub. Date: Mar. 7, 1996

[30] Foreign Application Priority Data

Aug. 29, 1994 [SE] Sweden ..... 9402745

[51] Int. Cl.[6] ..... H01C 7/10

[52] U.S. Cl. ..... 338/21; 361/126

[58] Field of Search ..... 338/20, 21, 101–106, 338/109–111; 361/126

[56] References Cited

U.S. PATENT DOCUMENTS

| | | | |
|---|---|---|---|
| 3,710,212 | 1/1973 | Marek et al. | 317/66 |
| 4,656,555 | 4/1987 | Raudabaugh | 361/117 |
| 4,962,440 | 10/1990 | Johnnerfelt et al. | 361/126 |
| 5,291,366 | 3/1994 | Giese | 361/127 |
| 5,517,382 | 5/1996 | Leupp et al. | 361/118 |

FOREIGN PATENT DOCUMENTS 0230103 of 1986 European Pat. Off. .

*Primary Examiner*—Teresa Walberg
*Assistant Examiner*—Jeffrey Pwu
*Attorney, Agent, or Firm*—Pollock, Vande Sande & Amernick

[57] ABSTRACT

A surge arrester comprising a stack of a plurality of cylindrical varistor blocks (10), preferably made of metal oxide, which are arranged one after the other in the axial direction of the varistor blocks between an upper end electrode (11) and a lower end electrode (12) and surrounded by an elongated, electrically insulating external casing (19) of rubber or other polymeric material. The end electrodes (11, 12) are interconnected by means of at least three clamping members (15) of insulating material to achieve the required contact pressure between the different elements (10–14) in the stack. Between the lower end electrode (12) and the first block (10) in the stack of varistors, there is arranged a pivot means comprising a centrally placed pivot member (17), projecting from the lower end electrode (12), said pivot member (17) making contact with a pressure plate (14), resting against the lowermost block (10) in the stack of varistors, to achieve articulation in all transverse directions.

11 Claims, 3 Drawing Sheets

SURGE ARRESTER

FIELD OF THE INVENTION

The present invention relates to a surge arrester comprising a stack of a plurality of cylindrical varistor blocks which are preferably made of metal oxide and are arranged one after the other in the axial direction of the varistor blocks between two end electrodes and surrounded by an elongated, electrically insulating outer casing of rubber or other polymeric material. The required contact pressure between the various instruments in the stack is provided achieved one or more clamping members extending between the two end electrodes and secured thereto.

DESCRIPTION OF RELATED ART

Surge arresters of the above-mentioned kind are previously known from the patent documents U.S. Pat. No. 4,656,555, U.S. Pat. No. 5,291,366 and EP-A-0 230 103. A drawback with these known designs is that they exhibit little resistance to mechanical influence in a direction transverse to the surge arrester.

To carry large currents, a sufficient contact pressure must be achieved between the blocks in the stack. In the known devices, this contact pressure is achieved by prestressing the varistor stack with an external mechanical, electrically insulating joint. The varistor stack is very stiff in relation to the prestress elements, and a transverse external load, applied to the upper end electrode, is absorbed as a bending stress in the varistor stack. This bending stress entails a force distribution over the surface of the varistor blocks which provides a compressive stress, increasing towards the edge, in the direction of deflection and a corresponding pressure relief in the opposite direction. Such pressure reliefs give rise to insufficient contact pressure and cannot, therefore, be accepted. A known solution to this problem is to increase the prestressing force such that sufficient contact pressure is obtained over the whole surface of the varistor blocks. However, the varistor blocks are brittle, so they can easily crack as a result of great compressive stresses at the edges. The known solutions therefore strike a balance between maintaining a sufficient contact pressure and not exceeding the strength of the varistor blocks with respect to bearing pressure.

A surge arrester of the kind described above may alone constitute the active part in a surge arrester for medium-voltage systems. A plurality of surge arrester may also, like modules, be connected together into a composite (series-connected) surge arrester intended for higher system voltages. When transverse load bears on such a surge arrester composed of several modules, a bending moment arises over the entire composite surge arrester. The varistor blocks in the lowermost arrester module are thereby subjected to very great compressive stresses and tensile stresses, respectively. A further drawback with these known designs is, therefore, that the resistance to external transverse forces is greatly reduced when joining surge arrester modules together.

SUMMARY OF THE INVENTION

The invention provides a surge arrester of the above-mentioned kind which has better resistance to external, transverse loads than prior art arresters. This is achieved according to the invention by strap-shaped prestress elements secured to the end electrodes and by a pivot means between the varistor stack and the lower end electrode. The prestress elements are arranged such that the end electrodes are connected to each other at at least three points, such that, in all directions, a bending moment caused by deflection is absorbed as tensile and compressive forces, respectively, in the prestress elements. Also, an external bending moment, attacking the upper end electrode, will be absorbed as tensile and compressive forces in the prestress elements. A surge arrester composed of a plurality of modules is therefore capable of withstanding considerably greater external transverse forces than a corresponding surge arrester composed of the known design.

A surge arrester module with a pivot means which is loaded with an external transverse force gives rise to a bending moment in the upper end electrode. This leads to the creation of a mechanical stress distribution over the surface of the uppermost varistor block, which is of the same magnitude as in the case without a pivot, but directed in the opposite direction. In the lower end of the varistor stack, no moment can be transmitted in case of an ideal pivot, and therefore no stress distribution arises over the lowermost varistor block. By constructing the pivot means such that it is partially capable of transmitting a bending moment, an additional advantage is obtained. In this case, a bending moment can be transmitted from the lower end electrode to the lower part of the varistor stack, which bending moment is directed in the opposite direction of the moment in the upper part of the varistor stack. The bending moments thus arising may be dimensioned to balance each other such that a considerably lower bearing pressure over the surface of the varistor blocks arises. Greater external transverse loads may thus be withstood.

The solution described above may be achieved with the pivot means consisting of an elastic plate. According to the invention, a pivot makes contact with the pressure plate, the pivot being formed with a plane surface towards the pressure plate. This results in an additional advantage in that the pivot point, when the surge arrester is deflected, is displaced in the deflected direction, whereby the torque arms to the prestress elements are changed. The torque arm of to the prestress element which is under tensile load becomes longer during the deflection, which results in a lower tensile load in the prestress element. In this way, the surge arrester is also given an initial stiffness, which means that a certain bending moment must be overcome before a greater deflection occurs.

The prestress elements may consist of straps, continuously wound of glass-fibre strand and embedded into polymer. The straps are clamped onto shoulders projecting from the end electrodes, for example as shown in the German patent application P 43 06 691 7. Through the pivot means, the surge arrester will have a larger deflection amplitude at transverse forces than in prior art designs. This means that, upon deflection, the straps resting against the shoulders projecting from the lower end electrode are subjected to an unfavorable force distribution in the direction of deflection. Upon such a deflection, the end electrodes are not only displaced in parallel, but they are also positioned at an angle to each other. The displacement and the angular adjustment mean that a cross section of a strap in an axial plane parallel to the direction of deflection will become subjected to different forces at the inner and outer edges of the cross section. The edge load thus arising becomes dimensioning for the total load-absorbing ability of the strap. A problem then arises in that the load-absorbing ability of the strap is reduced if, at the same time, deflection is to be allowed.

According to the invention, the above-mentioned problems are solved by pivoting a lower load-absorbing part of the shoulder from an upper part of the shoulder, integrated with the end electrode, by means of a joint in the tangential direction. That part of the shoulder which makes contact with the strap then has a force transmission which is evenly distributed in relation to the cross section of the strap. The force can then be transmitted in a torque-free manner to the fixed part of the shoulder through the joint, which may consist of a rounding of the lower part of the shoulder.

BRIEF DESCRIPTION OF THE DRAWINGS

The invention will be explained in greater detail by description of embodiments with reference to the accompanying drawings, wherein.

DETAILED DESCRIPTION OF THE PREFERRED EMBODIMENTS

Figure 1:
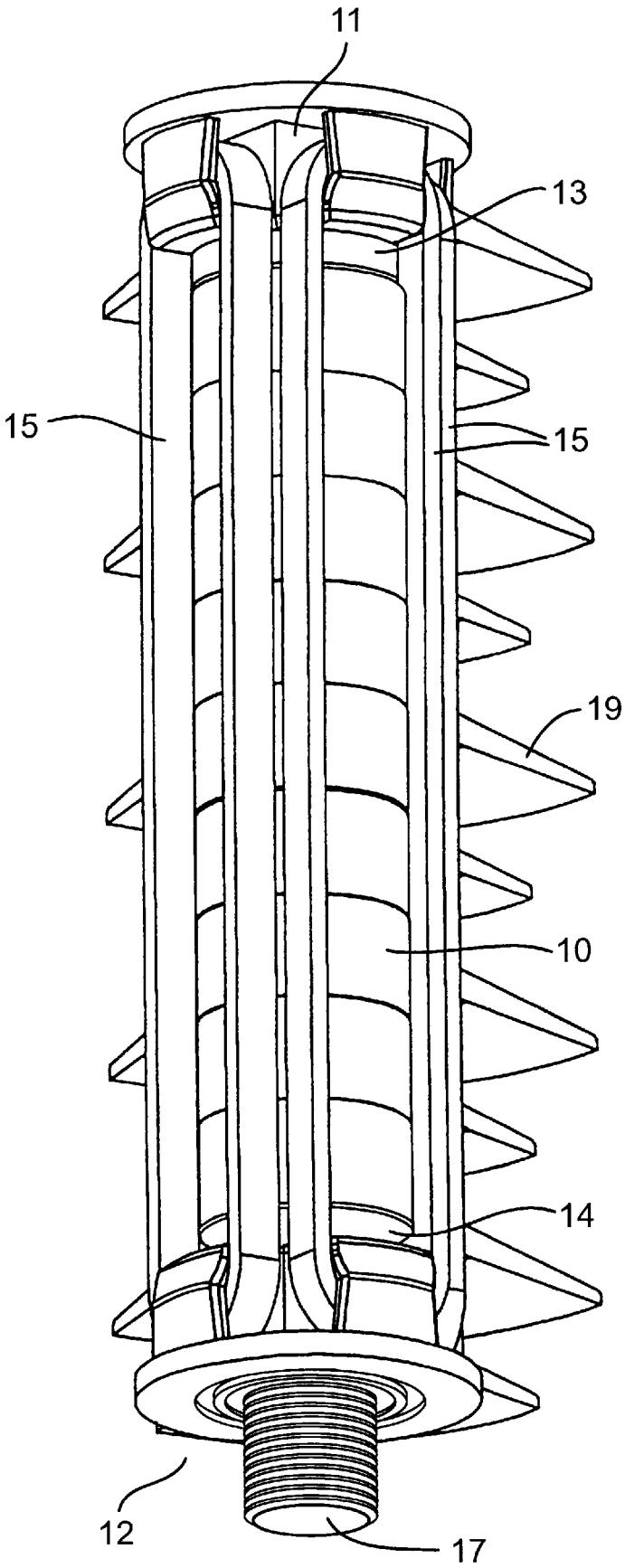
FIG. 1 is a three-dimensional picture of a surge arrester according to the invention with part of the casing of the arrester being cut away.
Figure 2:
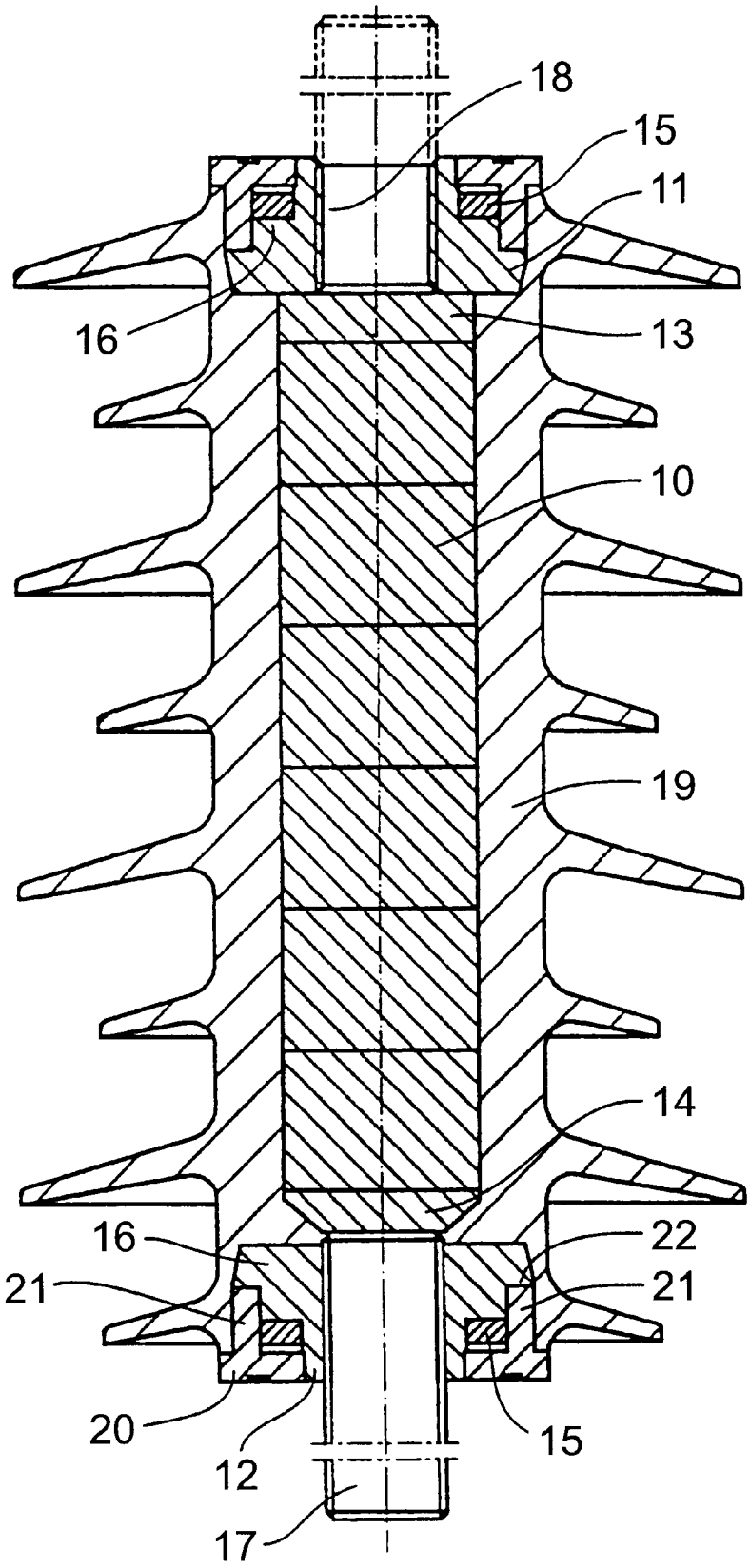
FIG. 2 shows such a surge arrester in an axial section.

The surge arrester modules shown in FIGS. 1 and 2 comprise a stack of a number of varistor elements 10 in the form of cylindrical ZnO blocks. The varistor stack is clamped between an upper end electrode 11 and a lower end electrode 12 with intermediate pressure plates 13, 14. The end electrodes and the pressure plates may be made of a electrically conducting material, for example aluminium. The axial compression of the varistor stack is achieved with the aid of four electrically insulating straps 15, which are wound of continuous glass-fiber strand with a plurality of turns and embedded into thermosetting resin. The straps are secured to the end electrodes, which are provided with four radially projecting shoulders 16 with cylindrical contact surfaces. The straps may be prefabricated and then be clamped on the stack composed of varistor blocks, washers and electrodes by tightening a screw 17 which is screwed into the lower end electrode and which at the same time functions as a joint screw or terminal.

The upper end electrode of the arrester module is provided with a threaded hole 18 for a screw to be screwed (series connection) to a similar module or for external connection. Each end the surge arrester is provided with an end yoke 20 comprising four lugs 21 arranged on a washer, each lug overlapping a shoulder 16 and making contact with a projecting support 22 at each shoulder. The lugs 21 reduce the deflection of the surge arrester and counteract lateral contraction forces in the straps 15. The end yokes 20 also transmit a torque when screwing together the surge arrester modules or the end connection. The surge arrester module is provided with a casing 19 applied by casting, preferably an elastomer, for example silicone rubber or ethylene propylene terpolymer (EPDM rubber).

Figure 3:
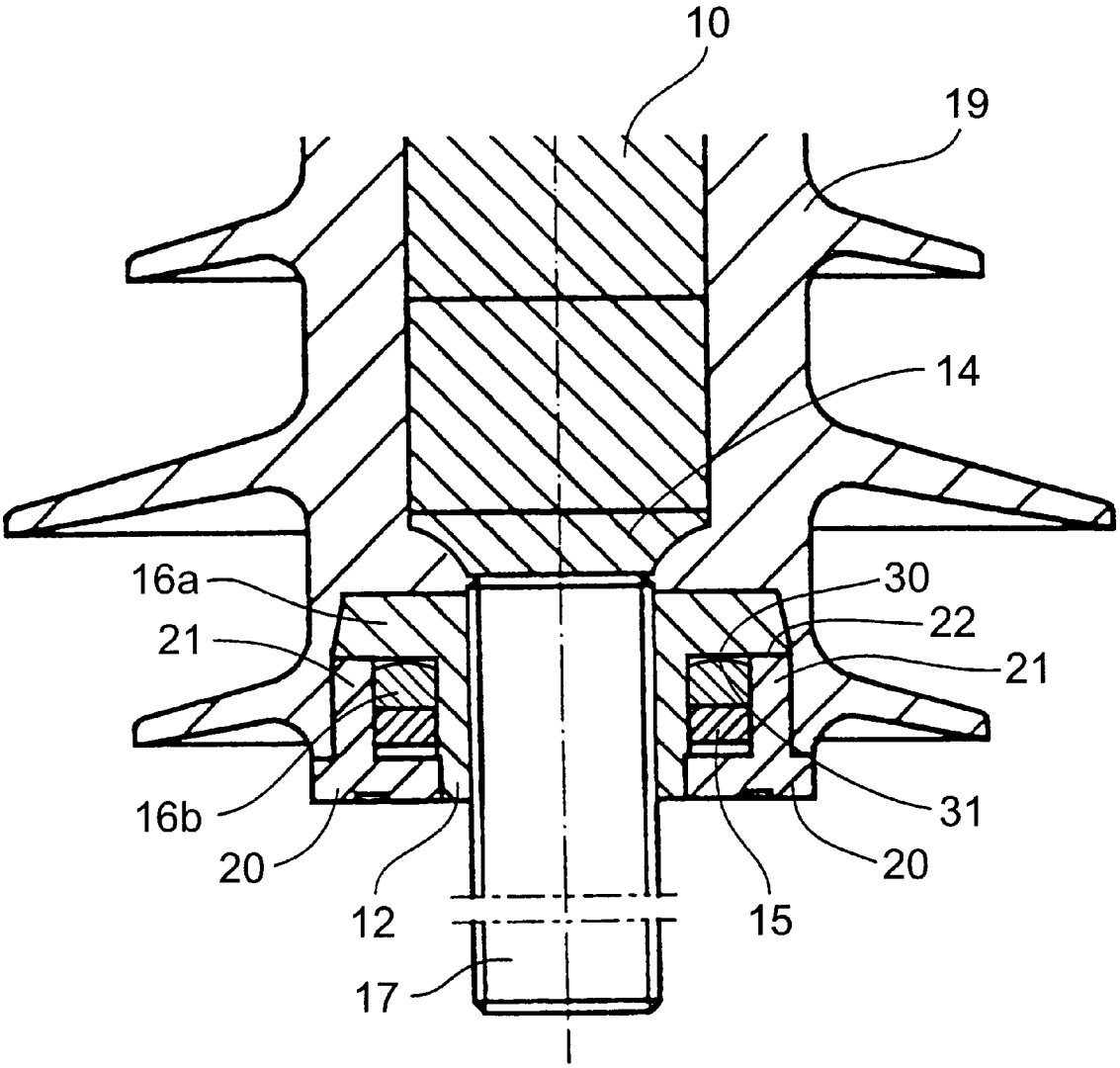
FIG. 3 shows an alternative embodiment of the lower part of the surge arrester.

FIG. 3 shows an alternative embodiment of the lower end electrode 12. The shoulders 16 projecting from the end electrode each comprise an upper fixed part 16*a*, integrated with the end electrode, and a lower pivoted part 16*b* which comprises the semicircular contact surface facing the strap 15. In a normal plane to the surge arrester, on a level with the support 22, the fixed part 16*a* is formed with a plane contact surface 30. The pivoted lower part 16*b* of the shoulder 16 is, in the same plane, formed with a cylindrical contact surface 31 resting against the contact surface 30, which contact surface 31 has a direction tangential to an axial plane through the center of the shoulder. In this way, the contact surfaces 30 and 31 form a joint through which forces from the strap 15 may be transmitted in a torque-free manner to the end electrode 12. For this reason, no uneven load of the cross section of the strap occurs when deflecting the surge arrester. The plate 14 abutting the screw 17 differs from the preceding example in that its edges are concave.

According to an advantageous development of the invention, the pivot means is made so stiff that it is able to partially transmit a bending moment. The bending moment arising at the lower end of the varistor stack can be dimensioned to partially counteract the bending moment at the upper end of the varistor stack. Through this design, the surge arrester can take up considerably greater transverse forces than in the known devices, and without exceeding the allowable bearing pressure in the varistor blocks. This may be achieved by replacing the pivot means with an elastic plate, inserted between the pressure plate 14 and the end electrode 12, with a modulus of elasticity corresponding to a few hundred MPa. When an insulated foot is desired, the elastic plate may be made of an electrically insulating, elastic material. In this embodiment, the electrical connection may be connected to the pressure plate 14.

The property of being able partially to transmit a bending moment may also be achieved by forming the screw 17, which is arranged through the end electrode 12, with a plane contact surface. The plane contact surface of the screw must then be given a sufficient diameter, so that a small torque arm is formed from the center to the edge of the screw, by which torque arm it is possible to transmit part of the external bending moment Lo the varistor stack. In this way, the pivot point is laterally adjusted in the direction of the deflection, whereby the torque arms to the straps 15 are favorably influenced such that smaller tensile forces arise in the straps 15.

We claim:

1. A surge arrester comprising:

an upper electrode;

a lower electrode;

a plurality of cylindrical varistor blocks stacked in the axial direction of said blocks between said upper and lower electrodes;

at least three straps of continuous strand interconnecting said upper and lower electrodes to achieve a predetermined contact pressure in the stack;

a pivot means arranged between a lowermost block in the stack and said lower electrode, said pivot means comprising a pivot member centrally placed and projecting from said lower electrode and a pressure plate resting against said lowermost block, said pivot member contacting said pressure plate; and an electrically insulating casing surrounding said blocks.

2. A surge arrester according to claim 1, wherein the pivot member comprises a screw for prestressing the stack of varistors.

3. A surge arrester according to claim 1, wherein the pivot member comprises at least one lining.

4. A surge arrester according to claim 1, wherein the pressure plate is formed with oblique edges.

5. A surge arrester according to claim 4, wherein the pressure plate is formed with concave edges.

6. A surge arrester according to claim 1, wherein the pivot member is formed with a plane surface making contact with the pressure plate.

7. A surge arrester according to claim 1, wherein the pivot member or the pressure plate is formed with a convex contact surface.

8. A surge arrester according to claim 1, wherein the pivot means further comprises an elastic plate arranged between the pressure plate and the end electrode.

9. A surge arrester according to claim 8, wherein the elastic plate is electrically insulating and the pressure plate is provided with an electric connection member.

10. A surge arrester according to claim 1, wherein the end electrodes are provided with radially projecting shoulders, with which the clamping members make contact, wherein each shoulder radially projecting from the lower end electrode comprises a fixed part, integrated with the end electrode, and a pivoted part in relation to the fixed part, whereby the joints are able to transmit, in a torque-free manner, compressive stresses from the clamping members to the end electrode.

11. A surge arrested according to claim 1, wherein at each end electrode an end yoke is arranged comprising lugs, whereby the deflection of the surge arrester can be reduced, the lateral contraction effect of the clamping members can be counteracted and, when joining surge arrester modules, torque can be transmitted.

* * * * *